US005581907A

United States Patent [19]

Kuma et al.

[11] Patent Number: 5,581,907

[45] Date of Patent: Dec. 10, 1996

[54] RAPID DEHYDRATING/DRYING DEVICE USABLE IN LOW TEMPERATURE

[75] Inventors: Toshimi Kuma; Toshihiro Masuzaki, both of Fukuoka, Japan

[73] Assignee: Kabushiki Kaisha Seibu Giken, Fukuoke-ken, Japan

[21] Appl. No.: 549,942

[22] Filed: Oct. 30, 1995

[30] Foreign Application Priority Data

Oct. 29, 1994 [JP] Japan ..... 6-301311

[51] Int. Cl.[6] ..... F26B 19/00

[52] U.S. Cl. ..... 34/572; 34/216; 34/388; 34/402

[58] Field of Search ..... 34/92, 143, 146, 34/215, 216, 388, 402, 403, 405, 572

[56] References Cited

U.S. PATENT DOCUMENTS

| | | | |
|---|---|---|---|
| 3,176,409 | 4/1965 | McKeever | 34/16 |
| 4,112,587 | 8/1978 | Sundman | 34/12 |
| 5,319,862 | 6/1994 | Ohgihara | 34/311 |

*Primary Examiner*—Henry A. Bennett

*Assistant Examiner*—Dinnatia Doster

*Attorney, Agent, or Firm*—Staas & Halsey

[57] ABSTRACT

An article to be dried is transferred and pressed and held between a wire endless conveyor and a flexible conveyor. The wire endless conveyor is placed between a nozzle, including a sucking-out nozzle and a blowing nozzle, and the cushion conveyor to press, hold and transfer the article to be dried. The nozzle dehydrates/dries the article to be dried. When an article to be dried is narrower than the width of the nozzle, the area where the article to be dried does not cover the sucking-out nozzle or the blowing nozzle is automatically shut by the flexible conveyor. The article to be dried is dehydrated/dried while it is pressed, held and transferred so that a high speed air jet stream and high speed negative pressure air stream do not flow out/in to outer air. While the article to be dried is transferred, pressed and held by the flexible conveyor, water adhering to it is formed into minute water drops by the high speed air jet stream and the high speed negative pressure air stream. The minute water drops are sucked and removed on the high speed negative pressure air stream. Thus dehydrating/drying can be performed continuously without water evaporation heat, in a short time and efficiently with little energy. Further, articles of various sizes and irregular shapes can be dried.

18 Claims, 10 Drawing Sheets

RAPID DEHYDRATING/DRYING DEVICE USABLE IN LOW TEMPERATURE

BACKGROUND OF THE INVENTION

1. Field of the Invention

The present invention relates to a rapid dehydrating/drying device usable in low temperature which can perform extremely efficiently and economically due to energy-savings. A dehydrating/drying device of the present invention uses a high speed fluid for drying sheet-type articles such as mats, carpets, fabrics, clothes, non-woven fabrics, synthetic resin film, glass, cardboard and printed articles or hoses.

2. Description of the Prior Art

Natural drying, ventilation drying, heated drying, high frequency heated drying, centrifugal dehydration drying, dehydrating/drying by pressurizing, heated drying using a rotary drum, and vacuum drying using pressure decrease have been used for drying mats, carpets, sheets and clothes. These drying methods require large amounts of heat energy and a great deal of time.

A flat mat such as a household foot mat, a business-use door mat or a carpet has various fibers implanted on a sheet surface of, for example, reinforcing rubber, etc., or has fabrics adhered to the surface of, for example, the rubber sheet. These types of mats are extremely hard to dry since they have no air passage in the direction of their thickness.

For the above-mentioned articles to be dried, natural drying and hot air drying require a long period of time. During heated drying using a rotary drum an article to be dried is put in a drum which is rotated. Hot air for drying is input into the drum. Mat fibers are damaged by friction and cracks are generated in the rubber sheet base material on the back of the mat. When high temperature wind is used, a great deal of heat energy is required and at the same time the mat fibers are deteriorated by the heat which substantially shortens their lives.

During vacuum drying using pressure decrease, vapor pressure in a vacuum vessel is decreased to evaporate the humidity contained in an article to be dried. As the article to be dried is dried taking away evaporation heat, it is cooled and sometimes it is frozen. Then it must be heated. Thus this method has a defect that a great deal of heat energy and motion power for a vacuum pump are needed and at the same time the drying time is long.

To eliminate the above defects, the applicants of the present invention proposed a low temperature rapid dehydrating/drying device in Japanese Patent Applications No-126742/1994 and No-222403/1994.

Japanese Patent Application No. 126742/1994 is directed to dehydrating/drying an article to be dried by finely dividing the water adhering to a wet mat into minute water drops by using only a negative pressure air stream or a negative pressure air stream and a high speed air jet stream. The minute water drops are sucked and removed from the wet mat. Japanese Patent Application No-222403/1994 is directed to a device that can continuously dehydrate/dry in low temperature in a short time by installing flanges in circumferential parts of a sucking-out opening and/or a blowing opening to prevent fluid from flowing into both nozzles thus forming a short cut with a high speed negative pressure air stream and outer air. Rather, the high speed air jet stream and the high speed negative pressure air stream reach deeply into the root of the fibers due to the acceleration of the high speed negative pressure air stream by the multiplication effect of the high speed air jet stream and the high speed negative pressure air stream.

The rapid dehydrating/drying device mentioned above can dehydrate/dry in extremely highly efficient manner when the width of the mat is almost the same as the widths of the sucking-out nozzle and of the blowing nozzle. But, when the width of the mat is narrower than the widths of both nozzles (the blowing nozzle and the sucking-out nozzle), the high speed air jet stream and the negative pressure air stream can freely flow in and out where the mat is not touching both nozzles, i.e., an open part of both nozzles where the mat is not covering both nozzles (hereinafter referred to as the open part).

Therefore, when flowing volume increases according to a P-Q curve (P is pressure (mmAq), Q is flowing volume ($m^3$/hr)), blowing pressure and sucking-in pressure decrease dramatically to make it impossible to secure a high speed air jet stream and a high speed negative pressure air stream necessary for drying the mat. Thus, the time for drying the mat becomes very long.

SUMMARY OF THE INVENTION

It is an object of the present invention to provide a low temperature rapid dehydrating/drying device which eliminates the above-mentioned defect of requiring a long time to dry.

It is another object of the present invention to provide a pressing conveying device that can efficiently dehydrate/dry even a mat narrower than the widths of the blowing nozzle and the sucking-out nozzle, regardless of the size of the mat.

It is still a further object of the present invention to dry a wet article such as a mat or carpet, especially mats of various sizes, having an impermeable rubber sheet lining, by making water adhering to fiber gaps, the fibers themselves and a fiber implanted rubber sheet surface, into minute water drops. This is achieved by the multiplication effect of combining the high speed air jet stream and the high speed negative pressure air stream. This does not decrease the dry air flow in fibers. A sucking-out nozzle and a blowing nozzle are held in pressing contact with the article to be dried. The article to be dried is transferred between a transfer conveyor and a cushion conveyor in pressing contact. The open part of the nozzles where the mat does not exist is pressurized using a cushioning characteristic of the cushion conveyor to automatically close the open part. Minute water drops are sucked from the sucking-out nozzle and exhausted without taking away water evaporation heat. This results in a continuous low temperature rapid dehydration/drying process.

The efficiency of drying an article to be dried is further increased when water adhering to the back of the mat where there are no implanted fibers is blown away using an air jet stream from a blowing nozzle. The back of the mat is then dried by setting it in contact with the heated cushion conveyor.

DESCRIPTION OF THE PREFERRED EMBODIMENTS

Figure 1:
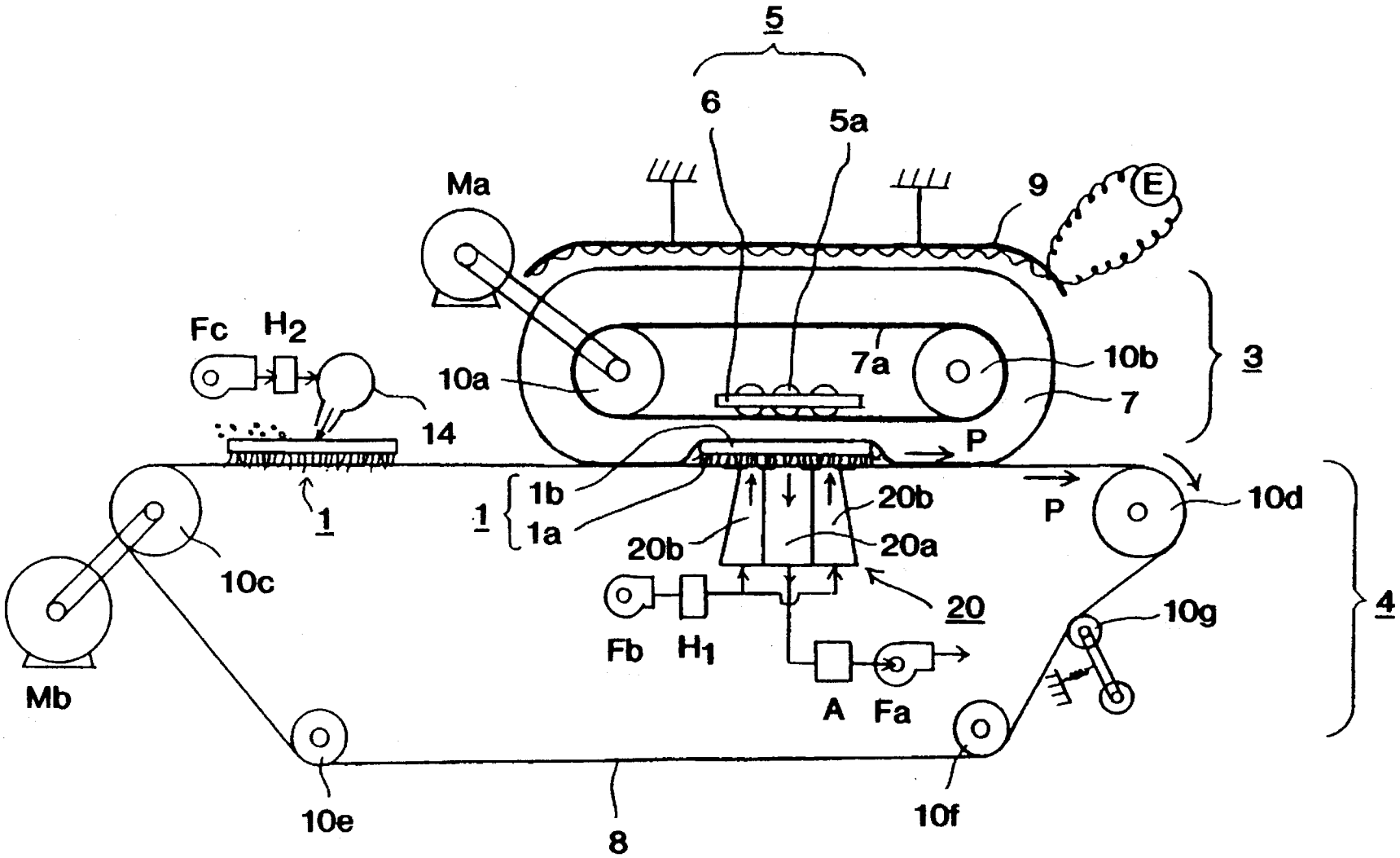
FIG. 1 is a cross-sectional view of a dehydrating/drying device according to a first embodiment of the present invention.
Figure 2:
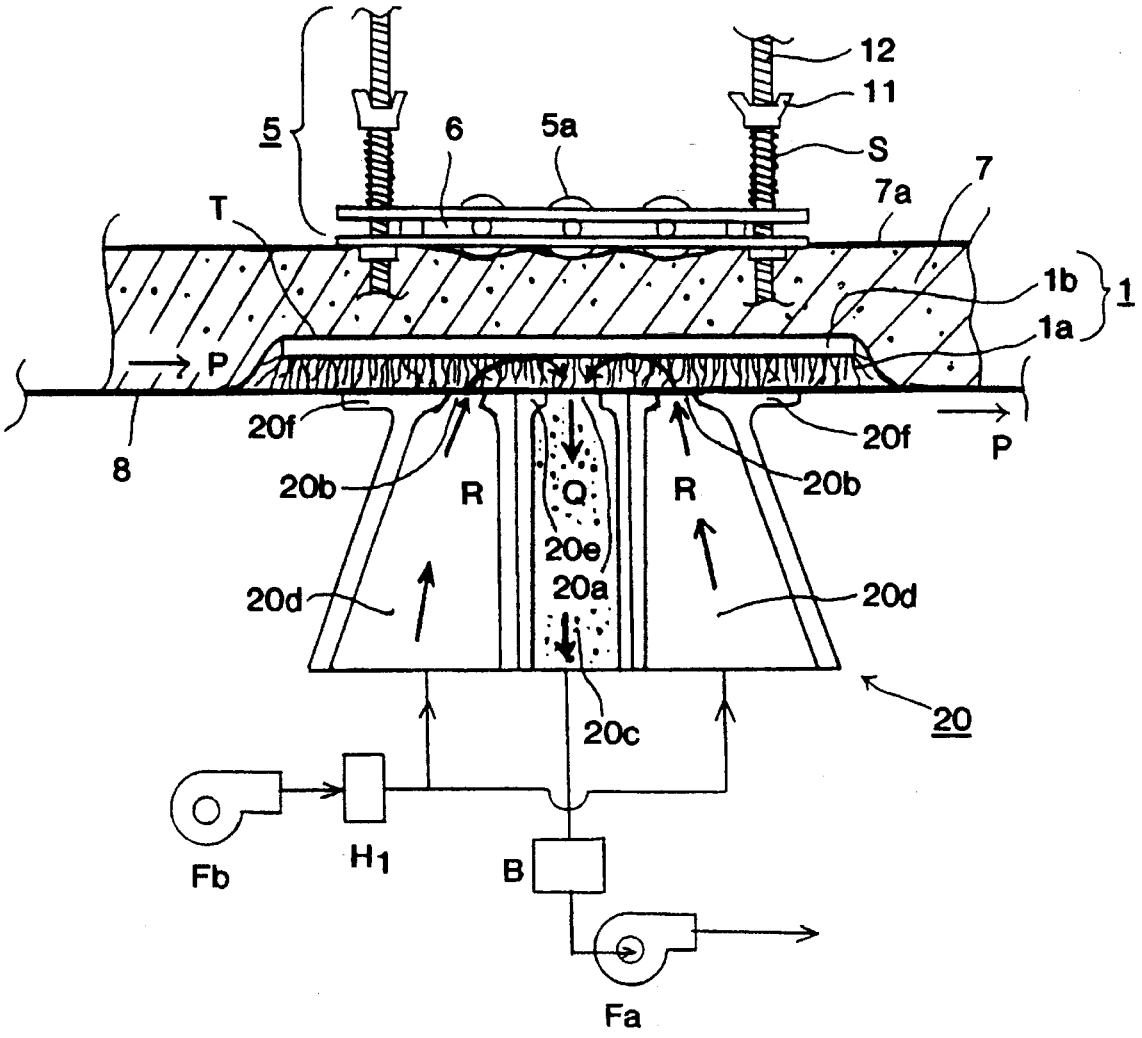
FIG. 2 is an enlarged view of an essential portion of the device shown in FIG. 1.

The structure and drying principle of a low temperature rapid dehydrating/drying device according to a first embodiment of the present invention is shown in FIGS. 1 and 2. The low temperature rapid dehydrating/drying device includes an air jet stream blowing pipe 14 in a preceding stage for receiving a wet mat 1 as an article to be dried. The wet mat 1 is held between a transferring endless conveyor 8 of a transferring device 4 and a cushion (foamed polyurethane) endless belt 7 of a pressing transferring device 3. The pressing transferring device 3 and the transferring device 4 transfer the mat 1 in pressing contact between the transferring endless conveyor 8 and the cushion endless belt 7. A pressing system 5 presses/holds/transports the mat 1 between the transferring endless conveyor 8 and the cushion endless belt 7. A heater 9 is installed near the upper surface of the cushion endless belt 7. A nozzle 20 includes a sucking-out nozzle 20*a* and a blowing nozzle 20*b* installed in a counter position to the pressurizing part of the cushion endless belt 7 with the transferring endless conveyor 8 located therebetween.

Figure 3B:
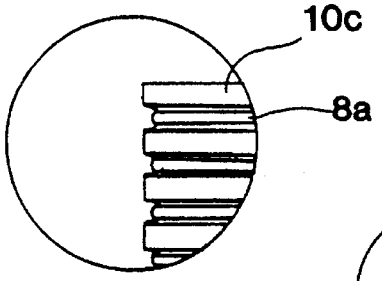
FIG. 3 is a plane view of an endless conveyor provided with wires.
Figure 3A:
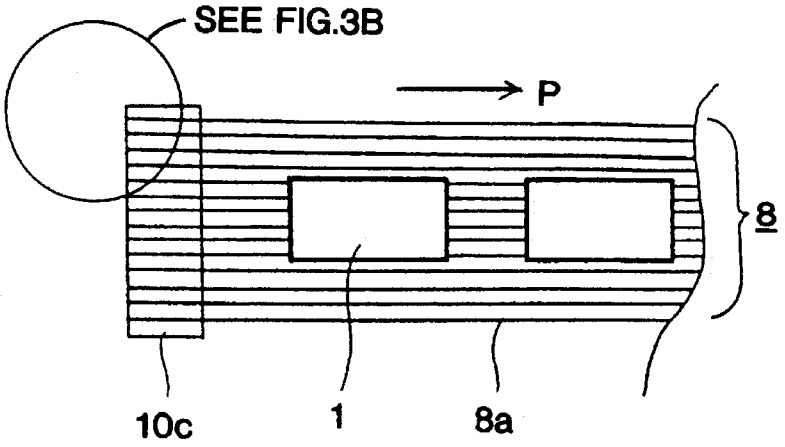

As shown in FIG. 1, the blowing pipe 14 has a blowing nozzle for outputting with a large force a heated air jet stream to remove water adhering to the back of the wet mat 1 before holding it between the transferring endless conveyor 8 and the cushion endless belt 7. The blowing pipe 14 is connected to an exhausting opening of a blower Fc. The transferring endless conveyor 8 of the transferring device includes numerous wires 8*a* as shown in FIG. 3, for transferring the mat 1. The endless conveyor 8 is installed among a driving pulley 10*c*, driven pulleys 10*d*, 10*e* and 10*f*, and a tension pulley 10*g* as shown in FIG. 1, and is moved by the driving motor Mb in the direction shown by the arrow P. In this case the driving pulley 10*c*, the driven pulleys 10*d*, 10*e* and 10*f* and the tension pulley 10*g* are provided with numerous grooves to guide the wires 8*a*. The width of the transferring endless conveyor 8 is approximately 1.8 m.

The cushion endless belt 7 of the pressing transferring device 3 is formed of foamed polyurethane (approximately 20–40 mm thick and approximately 1.8 m wide) with a strong driving belt 7*a* adhered to the inside. The cushion endless belt 7 is rotated by the driving motor Ma using the driving pulley 10 *a* and the driven pulley 10 *b*. The surface velocity of the wire endless conveyor 8 of the transferring device 4 and that of the cushion endless belt 7 of the pressing transferring device 3 are made the same.

To dry the back of the wet mat 1, a heater 9 is installed near the upper surface of the cushion endless belt 7 for heating the surface of the cushion endless belt 7.

Figure 4:
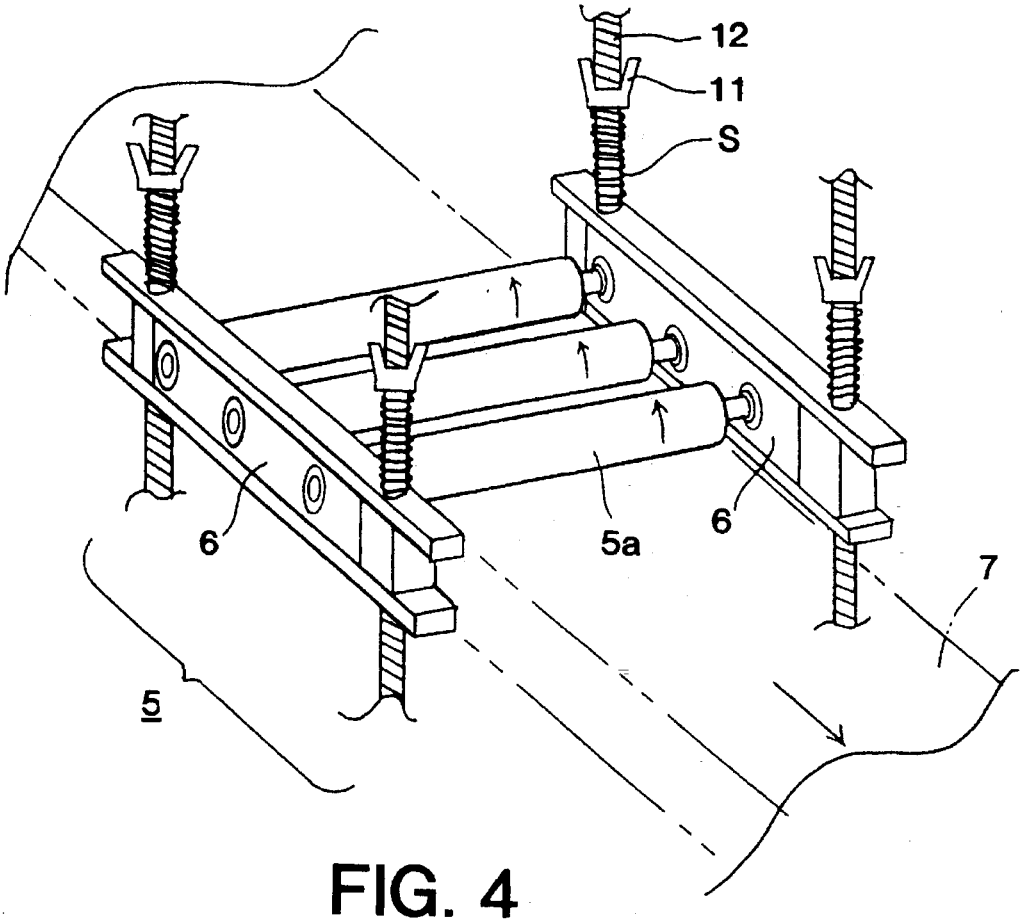
FIG. 4 is a perspective view of a pressurizing system.
Figure 5:
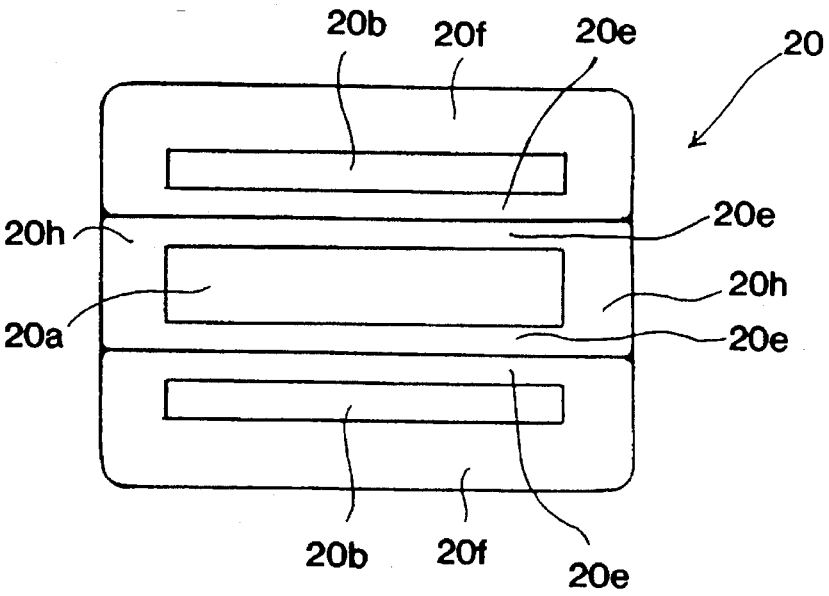
FIG. 5 is a top view of a nozzle.

In the pressurizing system 5 shown in FIG. 4, one or several rollers 5*a* are placed in parallel with the width direction of the cushion endless belt 7 and are rotatively fixed with bearings in-between by a bearing bar 6. A pressurizing force is controlled by bolts 12 provided with springs S outside and nuts 11. FIG. 2 is an enlarged drawing of an essential portion in FIG. 1. FIG. 5 is a plane view of the nozzle 20. As shown in both drawings, the wire endless conveyor 8 of the transferring device 4 is installed on the nozzle 20 so that it touches and can be slidably moved. The nozzle 20 is provided with a flange 20*e* in a circumferential part of the sucking-out nozzle 20*a*. The blowing nozzle 20*b* is provided with flanges 20*f* and 20*h* in a circumferential part installed on both sides of the sucking-out nozzle 20*a*. The sucking-out pipe 20*c* having the sucking-out nozzle 20*a* is connected to the sucking-in opening of the blower Fa with the water drop separating device B located therebetween. The blowing pipe 20*d*, having the blowing nozzle 20*b*, is connected to the exhausting opening of the blower Fb. A heater $H_1$ is placed between the blower Fb and the blowing pipe 20*d*.

The action of dehydration/drying will now be explained. As shown in FIG. 1, the wet mat 1 (approximately 0.9 m ×0.9 m and approximately 10 mm thick) is put on the wire endless conveyor 8 (approximately 1.8 m wide) of the transferring device 4 with the fibers 1*a* in a downward position. By operating the motors Mb and Ma, the wire endless conveyor 8 and the cushion endless belt 7 are moved at the same velocity of, for example, approximately 50 mm/s in the direction shown by the arrow P in the drawing. In the position preceding the holding of the mat 1 between the wire endless conveyor 8 and the cushion endless belt 7, the blower Fc is operated to output a high pressure air stream to the blowing pipe 14. This high pressure air stream passes through a heater $H_2$ and is output as a heated jet stream from the blowing pipe 14 at the surface of the mat base material 1*b* in an angle opposite to the proceeding direction of the mat 1 to blow away water on the surface of the mat base material to dry the mat base 1*b*. The mat 1 is then held between the wire endless conveyor 8 and the cushion endless belt 7.

The mat 1 is pressed and held between the cushion endless belt 7, which is pressurized from the inside by the pressurizing device 5, and the wire endless conveyor 8. The nozzle 20 is placed so that it touches and slides on the surface of the mat fibers 1*a* with the wire endless conveyor 8 therebetween to dry the fibers 1*a* of the mat 1 and at the same time the remaining water on the surface of the mat base material 1*b* is removed by heating the outer surface T of the cushion endless belt 7 by the heater 9 installed near the upper surface of the cushion endless belt 7.

The heater 9 used to dry the surface of the mat base material 1*b* can be properly selected from heaters such as a plane heater, a sheath heater and a far infrared ray heater. That is, any type of heater that can heat the surface of the cushion endless belt 7 to approximately 50°–80° C. can be used.

When drying the fibers 1*a* of the wet mat 1, since the width of the mat 1 is half the width of the nozzle 20, the open parts of the nozzles 20*a* and 20*b* are automatically closed by the cushion characteristic of the cushion endless belt 7 to prevent a decrease in the velocity of the high speed air jet stream and the high speed negative pressure air stream on the mat 1.

Figure 6:
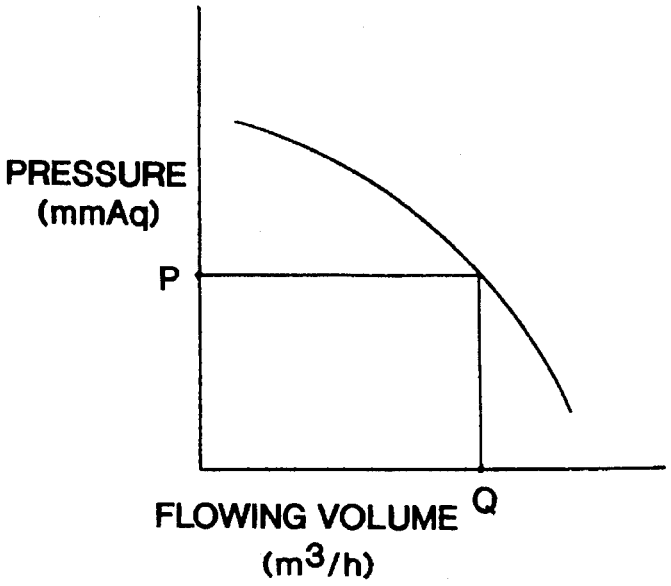
FIG. 6 is a flowing volume/pressure characteristic curve of a blower.

As shown in FIG. 6, the flowing volume pressure characteristic curve of a blower generally has a characteristic that a pressure P decreases when there is an increase in the flowing volume Q.

A pressurizing force is controlled by the bolts 12 (FIG. 4) which are provided with the springs S outside and the nuts 11 so that the open parts of the nozzle 20 are completely closed by the cushion endless belt 7 pressed from the inside by the rollers 5*a* of the pressurizing system 5.

The mat 1 is held pressed between the wire endless conveyor 8 and the cushion endless belt 7 and moved in the direction shown by the arrow P in FIGS. 1 and 2. At the same time the blowers Fa and Fb are operated and air is output from the exhaust opening of the blower Fb to the blowing pipe 20*d* of the nozzle 20. A high speed air jet stream R (FIG. 2) is output from the blowing nozzle 20*b*. A high speed negative pressure air stream Q output from the sucking-out nozzle 20*a* is applied to the fibers 1*a* of the mat 1 by the blower Fa. The sucking-out nozzle 20*a* and the blowing nozzle 20*b* are provided with flanges 20*e* and 20*f* respectively in a circumferential part. The high speed air jet stream R is prevented from flowing into the high speed negative pressure air stream Q directly as a short cut. The high speed air jet stream R does not flow out directly into the atmosphere due to the flanges 20*e* and 20*f*; but rather, flows into the root of the fibers of the mat 1 and is sucked into the sucking-out nozzle 20*a* along with the high speed negative pressure air stream Q.

A more detailed description of this phenomenon is as follows. Water adhering to the fibers of the mat 1 is made into minute water drops in the high speed negative pressure air stream Q by the multiplication effect of the high speed air jet stream R and the high speed negative pressure air stream Q. The minute water drops are sucked and exhausted by the sucking-out nozzle 20*a*. In an experiment, negative pressure in the sucking-out pipe 20*c* was approximately −1200 mmAq and pressure in the blowing pipe 20*d* was approximately +1000 mmAq. The temperature of the high speed air jet stream was approximately 40° C. Drying time of the wet mat (approximately 0.9 mm ×0.9 mm and approximately 10 mm thick, in which implanted fibers were approximately 7 mm long; transfer velocity of the wet mat being approximately 4 cm/s) was approximately 22.5 seconds in this case. Electricity consumption for drying was 0.25 kwH. Drying of a wet mat refers to a condition in which 95% of the water content of the mat is removed. Drying time becomes several times longer when the blowing pressure (+500 mmAq) and the sucking-in pressure (−500 mmAq) are decreased and the drying temperature is 40° C.

As a modified embodiment of the first embodiment of the present invention, a drying device may be used in which the pressing transferring device 3 and the transferring device 4 of the first embodiment are replaced, the wet mat 1 is put on the cushion endless belt 7 of the pressing transferring device 3 with the fibers 1*a* located in an upward direction and the nozzle 20 is installed inside the wire endless conveyor of the transferring device 4.

Figure 7:
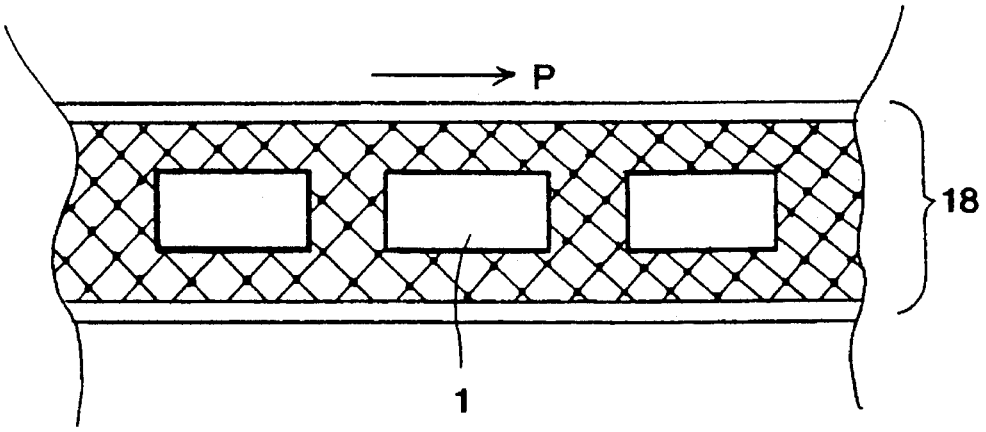
FIG. 7 is a plane view of a net-type endless conveyor.

In a further modified embodiment according to the present invention, a net-type endless conveyor 18 can be used as shown in FIG. 7 instead of the wire endless conveyor 8 of the transferring device 4 in the first embodiment. The net-type endless conveyor 18 used has a large opening ratio, for example, a mesh of 10 mm ×10 mm. The net-type endless conveyor 18 can be formed of a stainless steel wire, a strong holed belt of synthetic resin such as polyethylene, etc.

For the cushion endless belt 7 of the pressing transferring device 3, an expanded rubber with independent air bubbles and without a water sucking property can be used.

Figure 8:
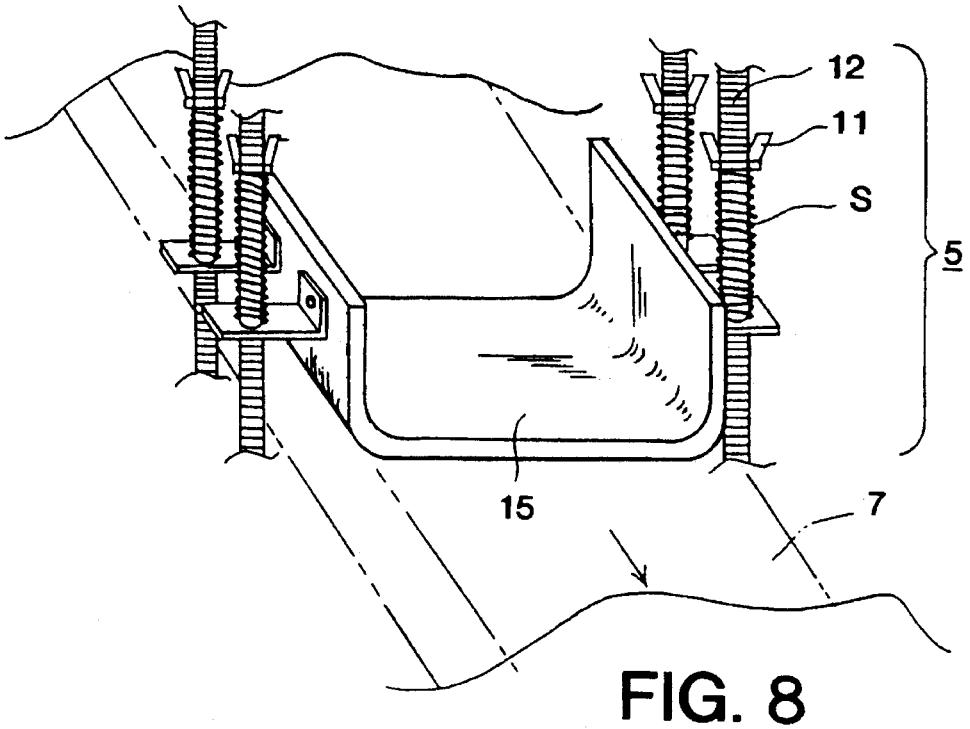
FIG. 8 is a perspective view of the pressurizing system according to the present invention.

For the pressurizing system 5, a conduit body 15 can be used, as shown in FIG. 8, having a bottom coated with polytetrafluoroethylene so that it slides smoothly on the driving belt 7*a* on the cushion endless belt 7 mentioned above.

Figure 9:
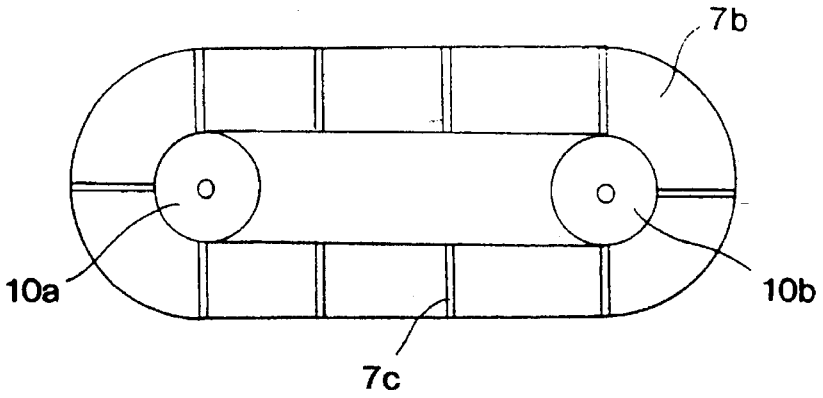
FIG. 9 is a plane view of a modified hollow body belt used in the first embodiment of the present invention.

The expanded rubber used for the cushion endless belt 7 in this further modified embodiment is either natural rubber or synthetic rubbers, and soft, organic high polymers such as polyethylene, foamed bodies made of these materials, and cushion hollow body belts 7*b* (FIG. 9). The cushion hollow body belt 7*b* is formed by rubber-coated cloth as shown in FIG. 9. The inside of the hollow body is divided by many reinforcing belts 7*c*. The cushion hollow body belt 7*b* is installed between the pulleys 10 *a* and 10 *b* and is rotated by driving the driving pulley 10*a*.

Figure 10:
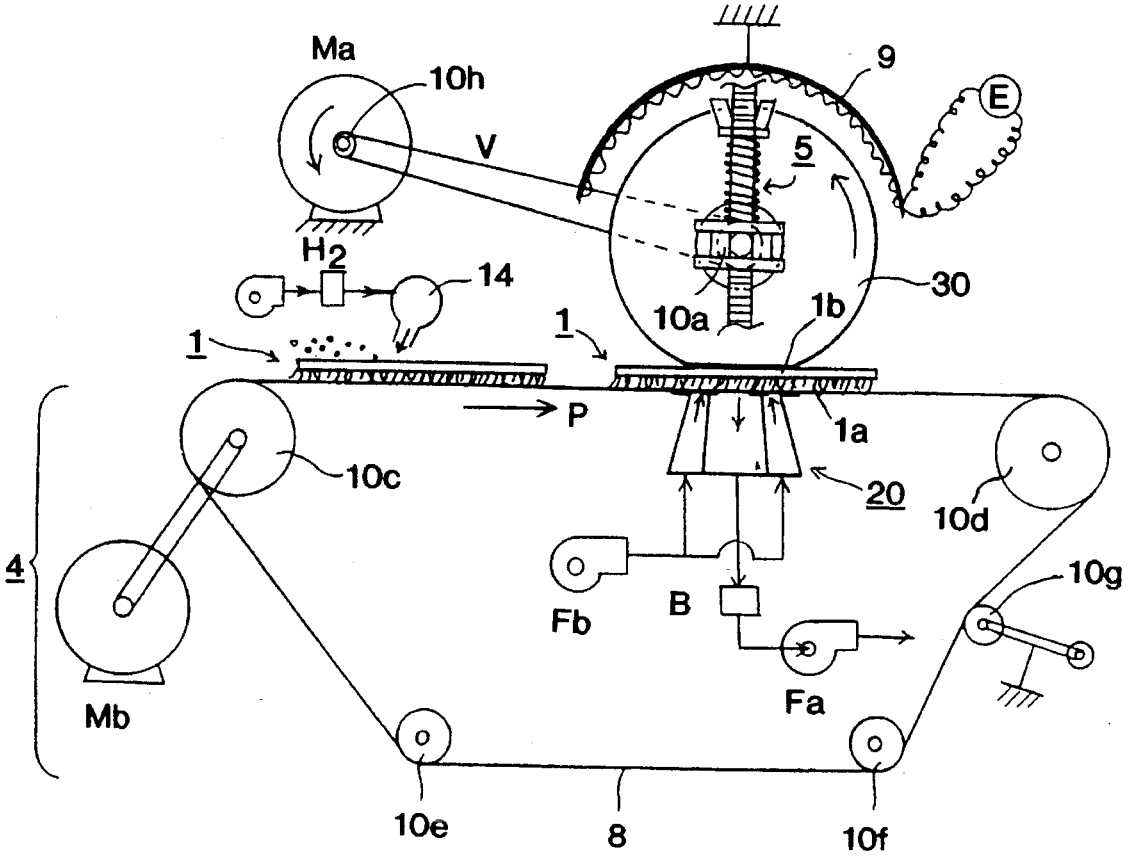
FIG. 10 is a cross-sectional view of a dehydrating/drying device according to a second embodiment of the present invention.
Figure 11A:
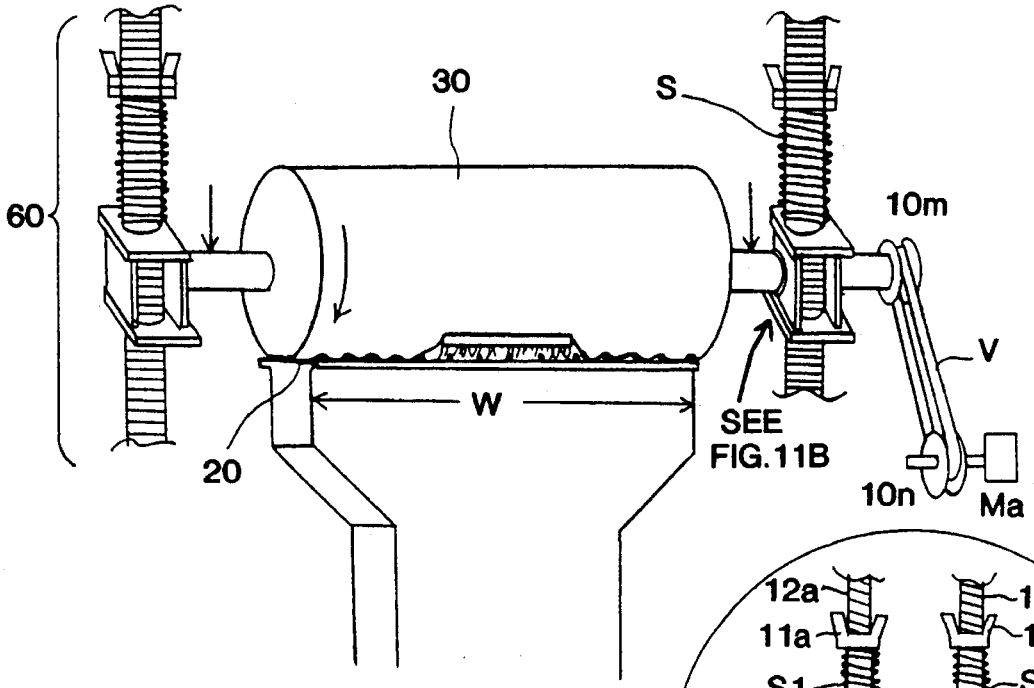
FIG. 11 is an enlarged view of an essential portion of the device shown in FIG. 10.
Figure 11B:
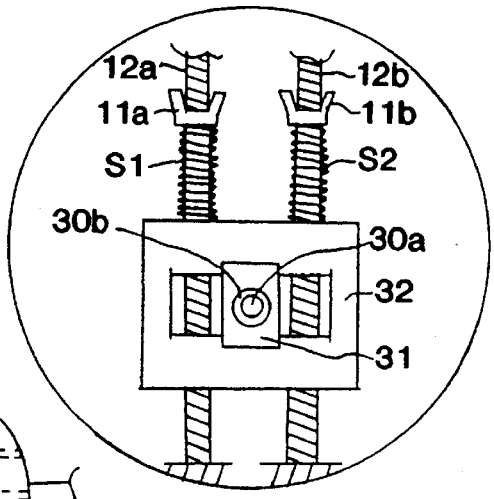

In a second embodiment according to the present invention, a cushion roller 30 (called a rubber roller 30 hereinafter) is used instead of the cushion endless belt 7 in the pressing transferring device 3 in the first embodiment in FIG. 1, as shown in FIGS. 10 and 11.

The rubber roller 30 is driven by a driving motor Ma through a pulley 10 m of a shaft 30*a*, a pulley 10*n* of the motor Ma and a belt V. The circulating velocity of the rubber roller 30 on the outer surface is the same as the line velocity of the wire endless conveyor 8. The wet mat 1 is held pressed between the rubber roller 30 and the surface of the nozzle 20 through the wire endless conveyor 8, is transferred and is dried.

A pressurizing device 60 (FIG. 11 ) of the rubber roller 30 includes a bearing holder 31, which holds a bearing 30*b* that fits in a shaft 30*a*, and a mobile frame 32 that holds the bearing 30*b*. Bolts 12*a* and 12*b* are installed at both ends of the rotationally mobile frame 32 so that it can slide freely. A pressurizing force to press the rollers 30 is controlled by springs $S_1$ and $S_2$ by controlling bolts 12*a* and 12*b*.

The rubber roller 30 is pressurized by compressing the pressurizing spring S by the nuts 12*a* and 12*b* of the pressurizing device 60. The rubber roller 30 is pressed against the open part of the nozzle 20 with the wire endless conveyor 8 therebetween to press the mat 1 against the nozzle 20 and at the same time to uniformly close up the surface of the open part of the nozzle 20 except the part where the mat 1 is located. Therefore the implanted part of the mat 1 contacts the surface of both the sucking-out nozzle 20*a* and the blowing nozzle 20*b* of the nozzle 20, and the high speed air jet stream and the high speed negative pressure air stream work completely on the implanted part of the mat 1 to dehydrate/dry it. Since the diameter of the numerous wires 8*a* used in the wire endless conveyor 8 is small (approximately 0.5–1.0 mm Φ (diameter)), the high speed air jet stream and the high speed negative pressure air stream can pass between the nozzle 20 and the rubber roller 30 even when the mat is placed thereon to dehydrate/dry the mat 1 without impeding the high speed air jet stream and the high speed negative pressure air stream.

Figure 12:
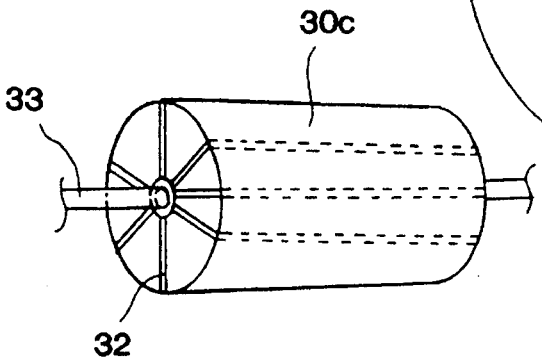
FIG. 12 is a perspective view of a modified example of a cushion roller used in FIG. 10 of the present invention.

The high speed air jet stream from the blowing pipe 14 (FIG. 10) drys the back of the mat 1 by strongly blowing away humidity and water drops on the back of the mat 1. In FIG. 10, $H_2$ is a heater. The heater 9, installed near the outer circumference of the rubber roller 30 as shown in FIG. 10, heats the surface of the rubber roller 30 which touches the back of the mat 1 and drys it. Alternatively to the rubber roller 30 shown in FIG. 11, a roller 30*c* shown in FIG. 12 can be used. The roller 30*c* is filled with air and includes rubber coated cloth which is divided by a reinforcing belt 32 as shown in FIG. 12. The rubber roller 30*c* maintains an almost cylindrical shape around the shaft 33 along its entire length.

Figure 13:
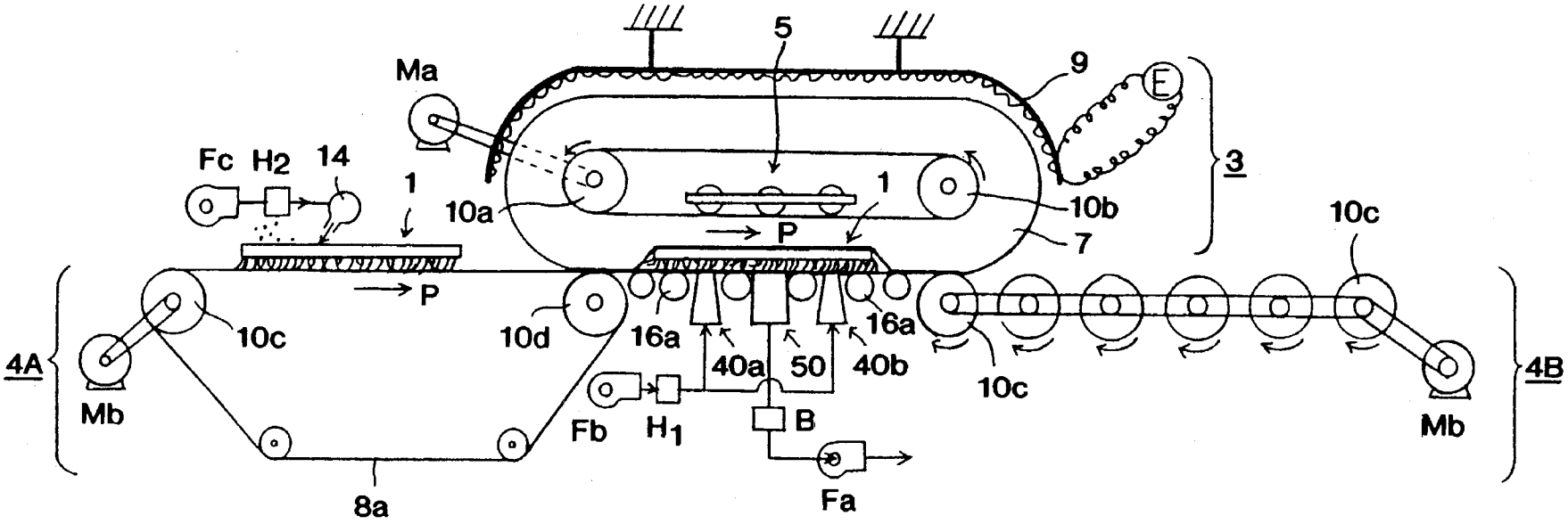
FIG. 13 is a cross-sectional view of a dehydrating/drying device according to a third embodiment of the present invention.
Figure 14:
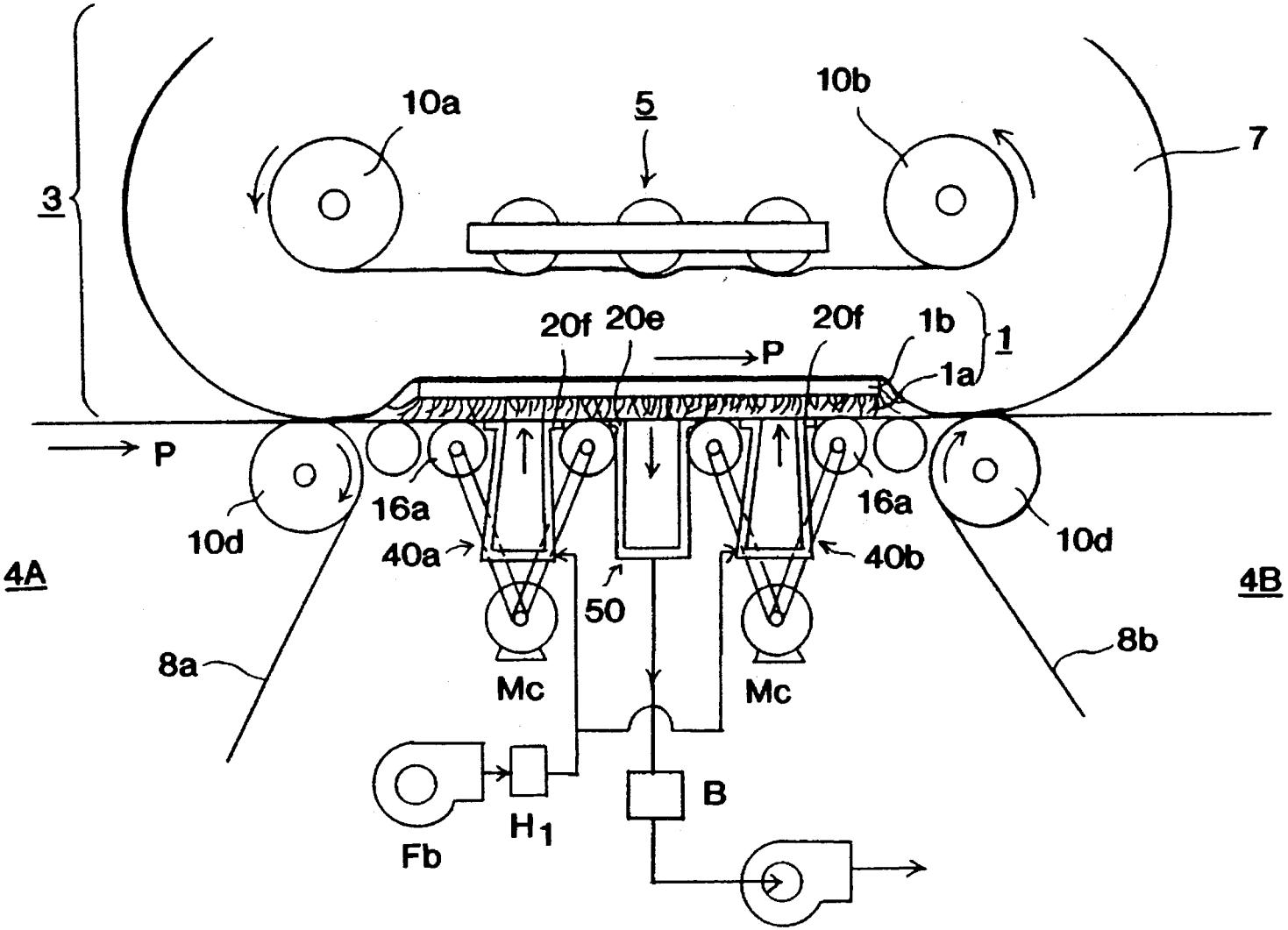
FIG. 14 is an enlarged view of an essential portion of the device shown in FIG. 13.

A third embodiment of a drying device according to the present invention is shown in FIGS. 13 and 14. This embodiment does not use a wire conveyor as a transferring conveyor.

FIG. 13 shows a rapid low temperature dehydrating/drying device including a pressing transferring device 3 which transfers a mat 1 by pressing and holding it between several transferring rollers 16*a*, installed between a preceding-stage transferring device 4A and a following-stage transferring device 4B, and a cushion endless belt 7. A pressurizing system 5 is installed inside the cushion endless belt 7 of the pressing transferring device 3. Blowing nozzles 40*a* and 40*b* and a sucking-out nozzle 50 are installed among the transferring rollers 16*a*. The number of blowing nozzles 40*a* and 40*b* and the sucking-out nozzles 50 can be properly selected.

As shown in FIG. 14, a mat 1 is placed with its fiber side 1*a* located in a downward direction. Water on the upper surface of the mat base material 1*b* is blown away. The wet mat 1 is transferred from the preceding transferring device 4A to the pressing device 5 by a transferring belt 8*a* and is pressed by the cushion endless belt 7 onto blowing nozzles 40*a* and 40*b* and the sucking-out nozzle 50 by the transferring rollers 16*a*.

The high speed air jet stream blows from the blowing nozzles 40*a* and 40*b* to the mat fibers 1*a*. At the same time water in the mat fibers 1*a* and water adhering to the fiber root is strongly sucked out as water drops together with the jet stream by the sucking-in high speed negative pressure air stream of the sucking-out nozzle 50 which is adjacent to the blowing nozzles 40*a* and 40*b*. Thus the mat 1 is dehydrated/dried and is transferred to the transferring rollers 10*c* (or the transferring belt 8*b* in FIG. 14) of the following-stage transferring device 4B.

Figure 15:
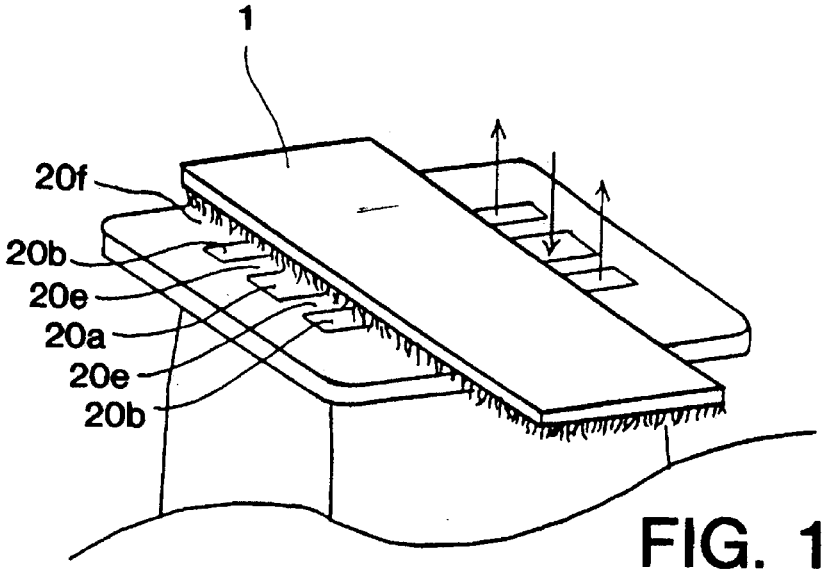
FIG. 15 is a perspective view showing an open part of both nozzles on which a mat is not placed.

The transferring rollers 16*a*, flanges 20*f* of the blowing nozzles 40*a* and 40*b* and a flange 20*e* of the sucking-out nozzle 50 are closely placed. The mat 1 is pressed from above and held by the pressed cushion endless belt 7 to close the open part of both nozzles (i.e., the open part of the blowing nozzles 40*a* and 40*b* and the sucking-out nozzle 50 where the mat does not cover; FIG. 15) to prevent flowing out and flowing in of the jet stream and the sucking in stream from the blowing nozzles 40*a* and 40*b* and the sucking-out nozzle 50. Therefore, a decrease of the blowing pressure and the sucking-in negative pressure in the part where the mat is placed, i.e., the part where the blowing stream and the sucking-in stream directly work on wet fibers, is prevented. A high speed air jet stream passes through the fibers 1*a* as the flanges 20*e* and 20*f* prevent the high speed air jet stream from flowing into the high speed negative pressure air stream. Thus dehydration/drying is continuously performed.

An endless belt of foamed polyurethane was used as the cushion endless belt 7. Circulating velocities of the foamed polyurethane endless belt 7, the transferring belts 8*a* and the transferring rollers 16*a* of the preceding stage transferring device 4A and the following-stage transferring device 4B are all made the same. The transferring rollers 16*a* are driven by the motor Mc.

Figure 16:
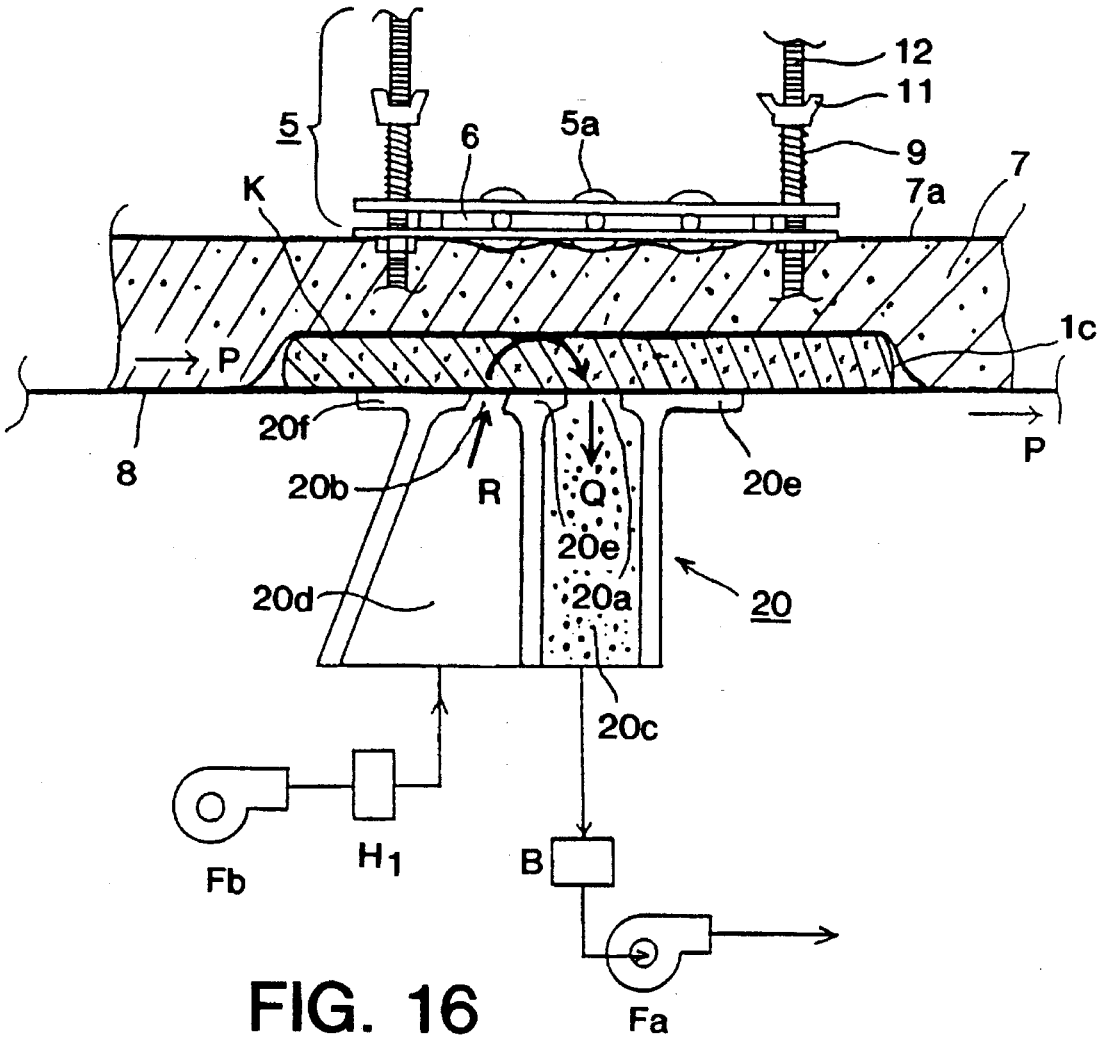
FIG. 16 is an enlarged view of an essential portion of a dehydrating/drying device according to the present invention when an article to be dried is a blanket.

FIG. 16 shows a device of the present invention drying a blanket as an example of an article to be dried without a rubber lining, etc. That is, articles having air passages in the direction of their thickness. The drying device is the same as the first embodiment shown in FIG. 1.

The wire endless conveyor 8 and a foamed polyurethane endless belt 7, having independent air bubbles and not having a water sucking property, are moved at a velocity of approximately 50 mm/s in the direction shown by the arrow P in the drawing. A wet blanket 1*c* is placed between the wire endless conveyor 8 and the foamed polyurethane endless belt 7.

The foamed polyurethane endless belt 7 presses the blanket 1*c* from the inside. It also presses the blanket 1*c* the entire length of the nozzle 20 and closes even the open part of the nozzle 20 where the blanket 1*c* does not exist. The wire endless conveyor 8 is transferred in the direction of the arrow P, pressing and holding the blanket 1*c*, to perform dehydration/drying. The wet blanket 1*c* being transferred touches and slides on both nozzles 20*a* and 20*b* as shown in the FIG. 16.

The high speed air jet stream R from the blowing nozzle 20*b* strongly blows at the surface of the wet blanket 1*c* and at the same time the high speed negative pressure air stream Q from the adjacent sucking-out nozzle 20*a* is made to work on the blanket 1*c*. Water in the blanket 1*c* then becomes minute water drops due to the multiplication effect of the high speed air jet stream R and the high speed negative pressure air stream Q sucked out in a large volume by the sucking-out nozzle 20*a* and exhausted into outer air. The sucking-out nozzle 20*a* and the blowing nozzle 20*b* are provided with flanges in their circumferential parts. Therefore, the high speed air jet stream R and the high speed negative pressure air stream Q do not flow together due to a short cut nor do they flow in/out directly to the atmosphere. The minute water drops pass through the blanket 1*c* to reach a level K of the foamed polyurethane endless belt 7. They then unite with the high speed negative pressure air stream Q and are sucked into the sucking-out nozzle 20*a* in the direction shown by the arrow in FIG. 16. Thus, water adhered to the inside of the blanket 1*c* becomes minute water drops due to the high speed negative pressure air stream R and are sucked out and exhausted by the sucking-out nozzle 20*a*.

In an experiment, approximately 90% of water adhering to the inside of the blanket 1*c* was sucked out in dehydration/drying device while the blowing pressure was approximately 700 mmAq. The sucking-out negative pressure was approximately −1000 mmAq and the blanket 1*c* was transferred at a transferring velocity of approximately 30 mm/s. In this case one blowing nozzle and one sucking-out nozzle were combined as shown by 20 in FIG. 16. The drying velocity was further increased by increasing the blowing pressure and the sucking-in pressure and by increasing the number of nozzles.

The above examples were explained using a mat or a blanket as an article to be dried. The present invention can also be used for drying wide carpets, garments, fabric clothes, non-woven fabrics, glass fiber sheets, long size sheets such as synthetic fiber sheets, artificial grass, a thin rush mat, a surface covering of a mat made of rush, papers, printed articles and fire hoses, and of course for drying during a manufacturing process of any of these.

In the present invention various mats narrower than the width W of the nozzle (FIG. 11 ) provided with a sucking-out opening and/or a blowing opening or mats of irregular shapes can be continuously, uniformly and rapidly dehydrated/dried in low temperature. When the width of an article to be dried is narrower than the width W of the nozzle, a cushion conveyor closes the open part of the nozzle by distorting itself due to its elasticity and transfers the mat. Therefore the air jet stream and the negative pressure air stream that contribute to drying of the wet mat do not exhibit decreases in their pressures and strongly act on the mat, sending in high speed dry air from the surface to deep inside the fiber root. The dry air unites with the negative pressure air stream and changes all the water adhered to the fiber surface, fiber gaps and fiber root into minute water drops, which are sucked out by the sucking-out nozzle, thus dehydrating/drying the mat. Therefore drying time can be greatly shortened and low temperature uniform dehydration/drying can be performed without uneven drying or damage to the fibers. Further, wrinkles in the article to be dried are smoothed out.

The rapid dehydrating/drying device of the present invention largely decreases the consumption of water evaporation heat and prevents a temperature decrease of the article to be dried. Therefore the heating energy for drying can be greatly saved, thus greatly conserving energy. What is more, the present invention can perform drying at low temperatures below 50° C. and can prevent heat deterioration of the material of the article to be dried. Compared with prior methods of dehydration by centrifugal force or by heating using a rotary drum, there is no damage due to friction of the article to be dried or by friction with the drying container. Thus, the present invention greatly prolongs the life of the article to be dried. Moreover, dust adhering to the article to be dried, especially ticks, vermin and other injurious insects and their eggs, can be completely sucked and removed by the high speed negative pressure air stream along with water drops. A cleaning and sanitizing effect is effected.

The foregoing is considered as illustrative only of the principles of the invention. Further, since numerous modifications and changes will readily occur to those skilled in the art, it is not desired to limit the invention to the exact construction and application shown and described, and accordingly, all suitable modifications and equivalents may be resorted to, fully within the scope of the invention and the appended claims and their equivalents.

We claim:

1. A rapid dehydrating/drying device usable in low temperature, comprising:

a nozzle including;

a blowing nozzle outputting a high speed air jet stream; and a sucking-out nozzle outputting a high speed negative pressure air stream;

an article to be dried located in a sliding position to said blowing nozzle and said sucking-out nozzle;

a transferring conveyor for conveying said article to be dried across said blowing nozzle and said sucking-out nozzle; and a flexible conveyor, said article to be dried pressed between said flexible conveyor and said transferring conveyor, automatically shutting down an air jet stream and a negative pressure air stream from an open part of said blowing nozzle and sucking-out nozzle when said article to be dried has a narrower width than that of said nozzle, preventing a decrease in pressure of said high speed air jet stream and said high speed negative pressure air stream.

2. A rapid dehydrating/drying device according to claim 1, wherein said high speed air jet stream from said blowing nozzle and said high speed negative pressure air stream from said sucking-out nozzle are combined.

3. A rapid dehydrating/drying device according to claim 1, wherein said flexible conveyor comprises an endless belt having an elastic property.

4. A rapid dehydrating/drying device according to claim 1, wherein said flexible conveyor comprises one or more elastic rollers whose pressure can be freely controlled.

5. A rapid dehydrating/drying device according to claim 3, wherein said endless belt comprises a material selected from the group consisting of soft organic high polymers such as natural rubber, synthetic rubbers, polyurethane, silicone rubber, polyethylene, soft polyvinyl chloride and sponge bodies of said soft organic high polymers.

6. A rapid dehydrating/drying device according to claim 4, wherein said elastic rollers comprise a material selected from the group consisting of soft organic high polymers such as natural rubber, synthetic rubbers, polyurethane, silicone rubber, polyethylene, soft polyvinyl chloride and sponge bodies of said soft organic high polymers.

7. A rapid dehydrating/drying device according to claim 1, wherein said flexible conveyor comprises one of a belt-type cushion hollow body filled with air and a roller-type elastic hollow body.

8. A rapid dehydrating/drying device according to claim 3, further comprising a pressurizing system including a pressing and holding part which pressurizes and compresses said endless belt from the inside against said sucking-out nozzle and said blowing nozzle, and automatically and continuously shuts the open part of said sucking-out and blowing nozzles using the elastic property of said endless belt.

9. A rapid dehydrating/drying device according to claim 8, wherein said pressurizing system further comprises one or more rotary rollers placed inside said endless belt in a direction of its width so that pressurizing can be freely controlled.

10. A rapid dehydrating/drying device according to claim 9, wherein said pressurizing system further comprises a plate-type body placed so that it presses and slides on an inner side of said endless belt.

11. A rapid dehydrating/drying device according to claim 8, wherein said pressurizing system provides a pressing force to said pressing and holding part of said endless belt using pressurized fluid.

12. A rapid dehydrating/drying device according to claim 1, wherein said transferring conveyor includes numerous wires.

13. A rapid dehydrating/drying device according to claim 1, wherein said transferring conveyor is a net-type conveyor.

14. A rapid dehydrating/drying device according to claim 1, wherein said transferring conveyor is a porous belt.

15. A rapid dehydrating/drying device according to claim 1, wherein said transferring conveyor comprises arranged rollers.

16. A rapid dehydrating/drying device according to claim 3, further comprising a heat generating body placed near said endless belt and a surface of said article to be dried to heat said endless belt.

17. A rapid dehydrating/drying device according to claim 4, further comprising a heat generating body placed near said elastic rollers and a surface of said article to be dried to heat said elastic rollers.

18. A rapid dehydrating/drying device according to claim 1, further comprising a blowing pipe to dry the back of said article to be dried before being held between said flexible conveyor and said transferring conveyor to blow away water adhering to the back of said article to be dried by one of an air jet stream and a heated air jet stream.

* * * * *